US005784823A

United States Patent [19]

Chen

[11] Patent Number: 5,784,823

[45] Date of Patent: Jul. 28, 1998

[54] LASER SIGHT ASSEMBLY

[75] Inventor: Kuo-Ti Chen, Pin-Chen, Taiwan

[73] Assignee: Quarton Inc., Taipei, Taiwan

[21] Appl. No.: 844,331

[22] Filed: Apr. 18, 1997

[51] Int. Cl.[6] ..... F41G 1/34; F41C 3/14

[52] U.S. Cl. ..... 42/103; 42/100; 362/110

[58] Field of Search ..... 42/103, 100, 101, 42/105; 89/41.17, 41.19; 362/110, 113, 114, 111, 112

[56] References Cited

U.S. PATENT DOCUMENTS

| | | | |
|---|---|---|---|
| 4,856,218 | 8/1989 | Reynolds, Jr. | 42/103 |
| 4,876,816 | 10/1989 | Triplett | 42/103 |
| 4,939,863 | 7/1990 | Alexander et al. | 42/103 |
| 5,033,219 | 7/1991 | Johnson et al. | 42/103 |
| 5,253,443 | 10/1993 | Bikrich | 42/103 |
| 5,282,594 | 2/1994 | Huang | 42/100 |
| 5,323,555 | 6/1994 | Jehn | 42/103 |

*Primary Examiner*—Charles T. Jordan
*Assistant Examiner*—Theresa M. Wesson
*Attorney, Agent, or Firm*—Rosenberg, Klein & Bilker

[57] ABSTRACT

A laser sight assembly comprising a casing adapted for fixing to a gun, etc., a socket member mounted in the casing, and a laser module mounted in the socket member and controlled to emit a laser beam for guiding the eye, wherein the casing is comprised of two symmetrical shells connected together by screws and defining a ball socket. The socket member is a hollow, spherical, split socket turned in the ball socket and positioned at the designed angle within the casing by a frictional force. The laser module has a detachable power control device fastened thereto by a screw joint for operation control, and is turned with the socket member within the ball socket to the desired angle.

13 Claims, 8 Drawing Sheets

LASER SIGHT ASSEMBLY

BACKGROUND OF THE INVENTION

The present invention relates to laser sight assemblies, and more particularly to such a laser sight assembly that is easy to install and, which permits the firing angle of the laser module to be conveniently and quickly adjusted to the desired angle.

A variety of laser sight means have been disclosed for use with a gun, etc., for guiding the eye. Exemplars of these laser sight means are seen in U.S. Pat. Nos. 5,282,594; 5,323,555 and these laser sight means are complicated. In the case where the laser module is unable to function well, it is difficult to be detached from the assembly for replacement or repair. Further, when adjusting the firing angle of the laser module, the laser module must be adjusted in X-axis and then in Y-axis separately and troublingly.

FIG. 1 shows a laser sight assembly 8 installed in a pistol according to the prior art. This structure of laser sight assembly 8 uses an adjustment screw 81 to adjust the firing angle of the laser module 82. FIG. 2 shows another structure of laser sight assembly 9 used with pistol in accordance with the prior art. According to this structure of laser sight assembly 9, the adjustment of firing angle of the laser module 91 is controlled through an adjustment screw 92. This laser firing angle adjustment arrangement is not practical in function because the adjustment screw 92 wears quickly with use (see FIG. 3).

SUMMARY OF THE INVENTION

It is one object of the present invention to provide a laser sight assembly which is simple in structure and can easily be installed. It is another object of the present invention to provide a laser sight assembly which can conveniently be adjusted to the desired firing angle. It is still another object of the present invention to provide a laser sight assembly which is easy to maintain. It is still another object of the present invention to provide a laser sight assembly which permits the laser module to be separately used as an independent laser pointer.

According to one aspect of the present invention, the laser sight assembly is comprised of a casing adapted for fixing to a gun, etc., socket member mounted within the casing, and a laser module mounted in the socket member and controlled to emit a laser beam for guiding the eye, wherein the casing is comprised of two symmetrical shells connected together by screws and defining a ball socket; the socket member is a hollow, spherical, split socket turned in the ball socket and positioned at the designed angle within the casing by a frictional force. Therefore, the socket member can be turned within the ball socket in all directions to change the firing angle of the laser module as desired. According to another aspect of the present invention, the laser module has a detachable power control device fastened thereto by a screw joint for operation control. According to still another aspect of the present invention, a screw cap with a metal clip is provided for attaching to the laser module so that the laser module can be used with the screw cap as a laser pointer. According to still another aspect of the present invention, the casing and the laser module are respectively coated with a layer of fluorescent material.

DETAILED DESCRIPTION OF THE PREFERRED EMBODIMENT

Figure 1:
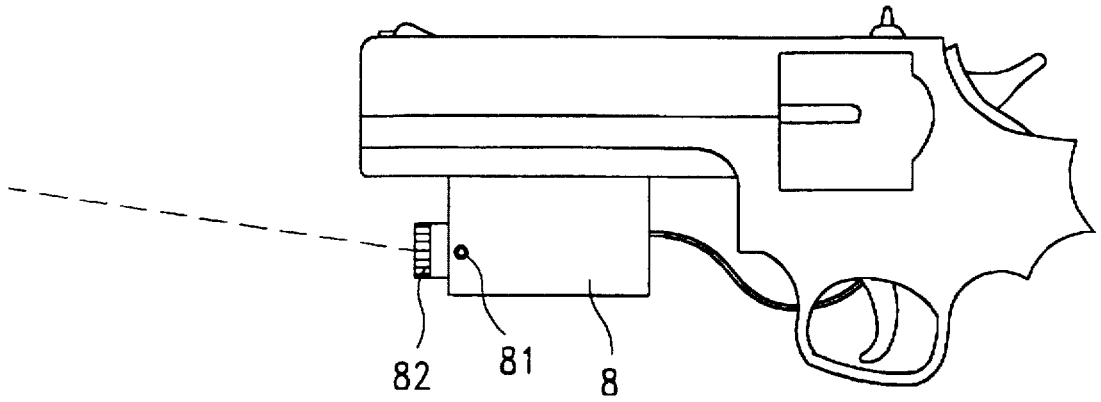
FIG. 1 is a plain view of a pistol equipped with a laser sight assembly according to the prior art.
Figure 2:
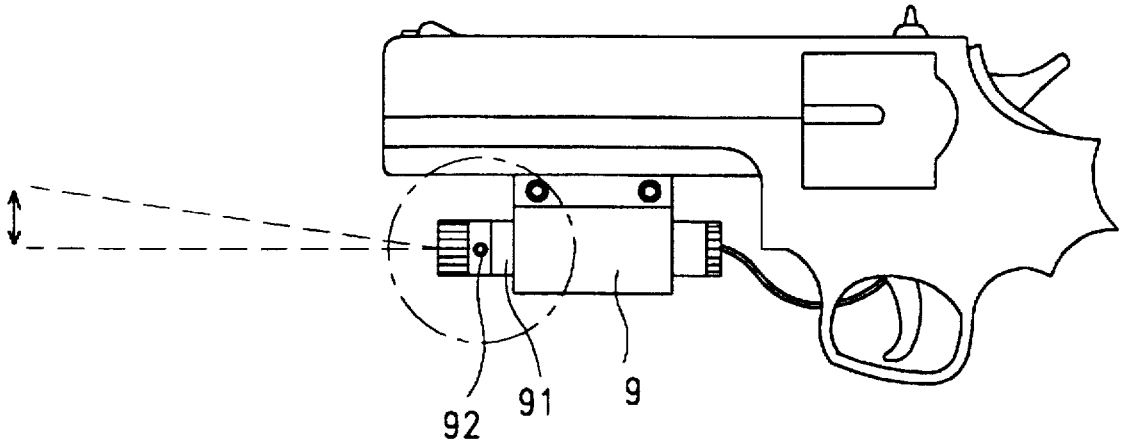
FIG. 2 shows another structure of laser sight assembly installed in a pistol according to the prior art.
Figure 3:
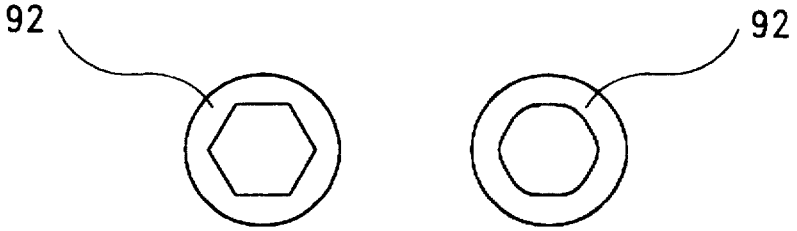
FIG. 3 is a schematic drawing showing the wearing of the adjustment screw of the laser sight assembly shown in FIG. 2.
Figure 4:
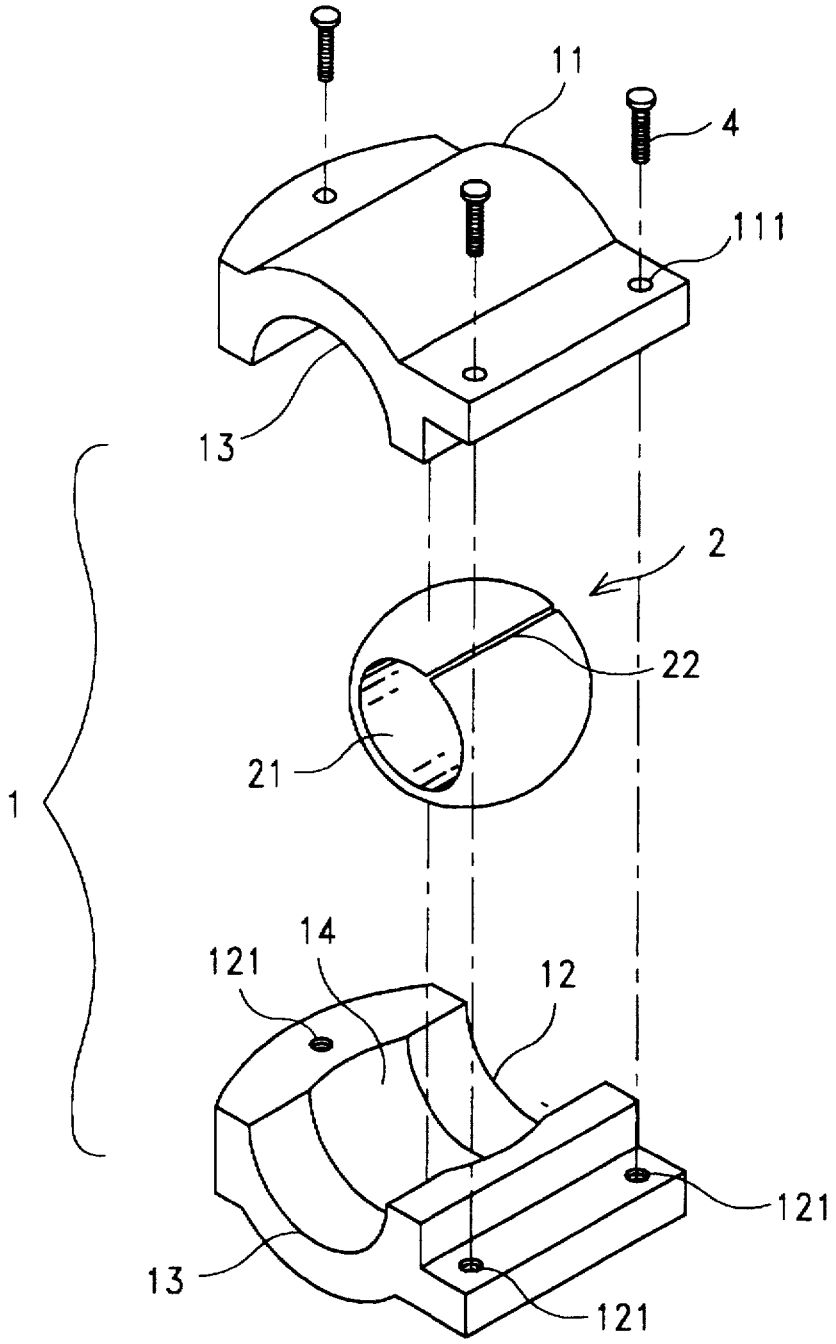
FIG. 4 is an exploded view of a casing and a split socket for a laser sight assembly according to a preferred embodiment of the present invention.
Figure 5:
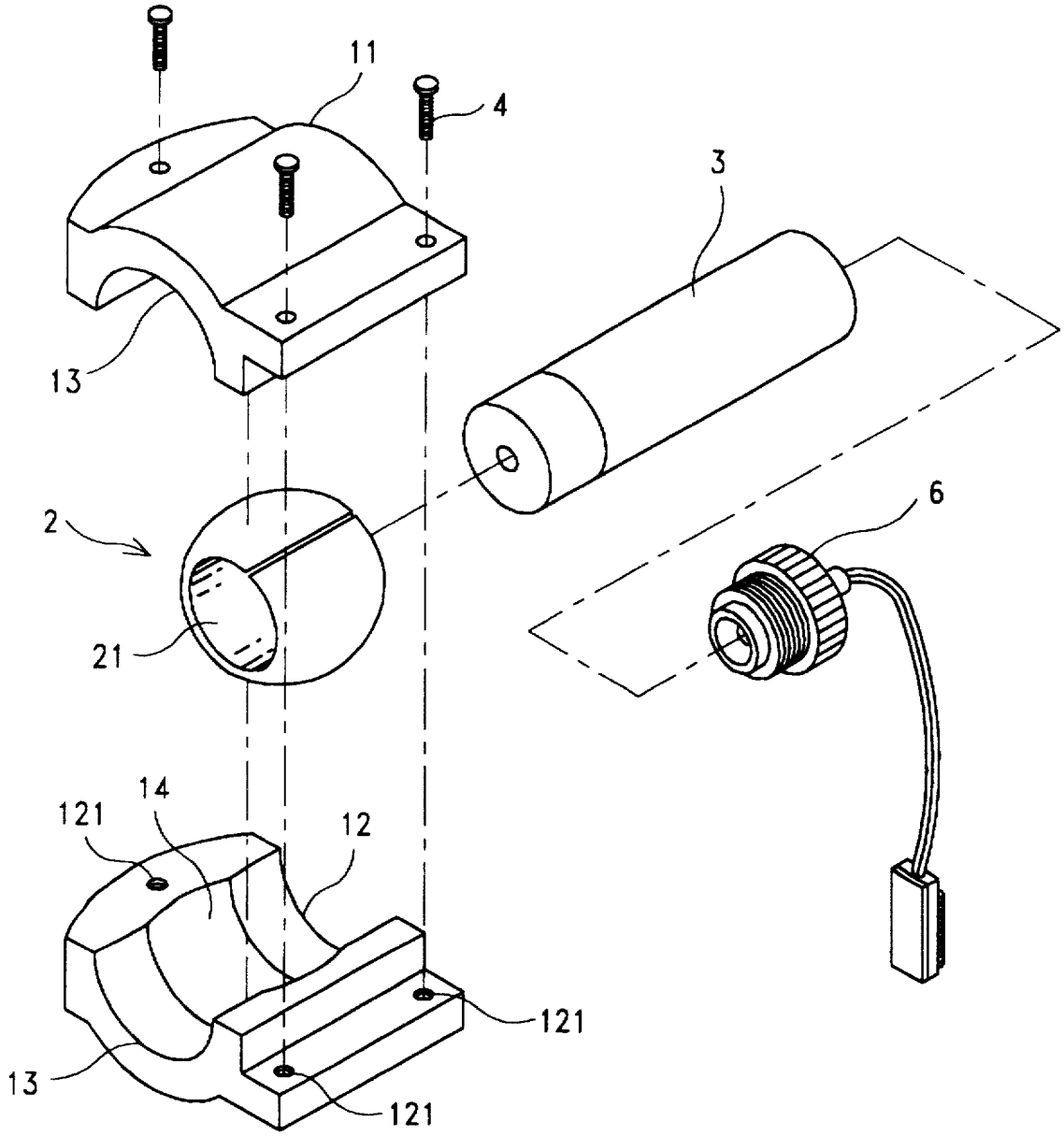
FIG. 5 is an exploded view of the laser sight assembly according to the preferred embodiment of the present invention.

Referring to FIGS. 4 and 5, a laser sight assembly in accordance with the present invention is generally comprised of a casing 1, a split socket 2, and a laser module 3.

Figure 7:
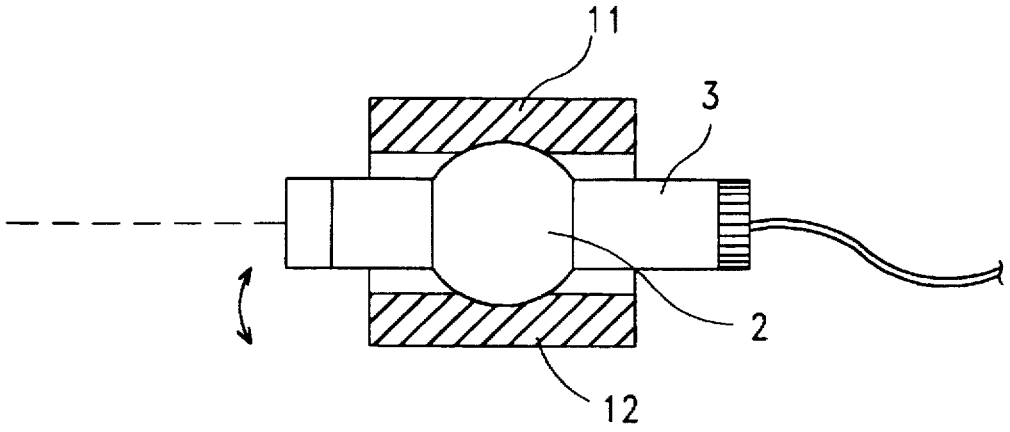
FIG. 7 is a sectional view of the present invention, showing the firing angle of the laser module adjusted in one direction.
Figure 8:
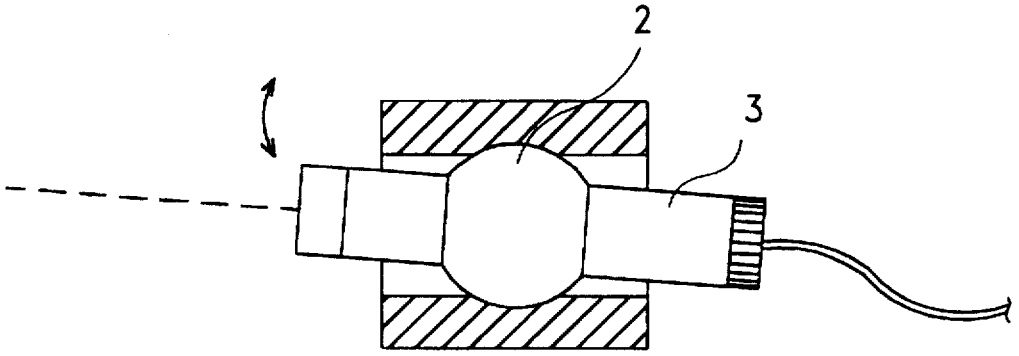
FIG. 8 is another sectional view of the present invention, showing the firing angle of the laser module adjusted in another direction.

Referring to FIGS. 7 and 8, and FIGS. 4 and 5 again, the casing 1 is comprised of two symmetrical shells, namely, a top shell 11 and a bottom shell 12. The top shell 11 has a plurality of through holes 111 respectively fastened to respective screw holes 121 on the bottom shell 12 by screws 4. The top shell 11 and the bottom shell 12 comprise a respective longitudinal channel 13, and a respective smoothly curved transverse groove 14 on the respective longitudinal channel 13 in the middle. The split socket 2 comprises a center through hole 21 adapted for holding the laser module 3, and a longitudinal split 22 cut through the periphery. The split socket 2 has a spherical shape. When the split socket 2 is mounted within the casing 1 between the smoothly curved transverse grooves 14 of the top shell 11 and the bottom shell 12 to hold the laser module 3 on the inside, the split socket 2 can be turned within the casing 1 to adjust the angular position of the laser module 3 (see FIGS. 7 and 8). Because the split socket 2 has a longitudinal split 22 and a spherical shape fitting the smoothly curved transverse grooves 14, it can be conveniently turned within the casing 1 and then immediately set in position when released. When the laser module 3 is installed, a power control device 6 is fastened to the laser module 3 for controlling its operation by a screw joint.

Figure 9:
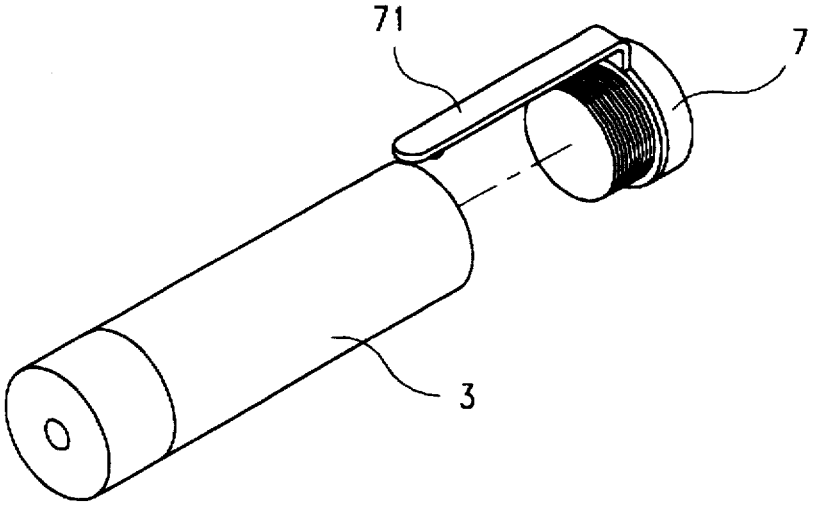
FIG. 9 shows an use of the laser module with a screw cap according to the present invention.
Figure 10:
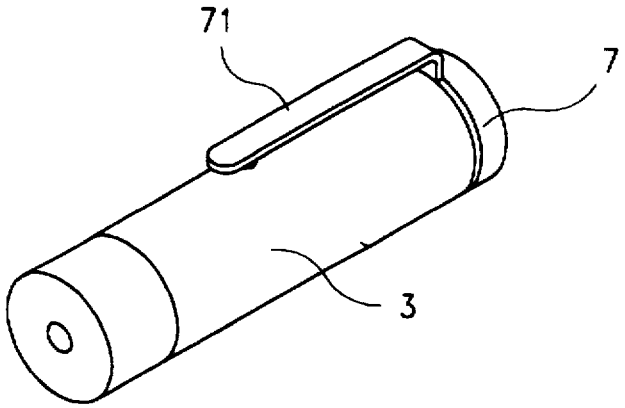
FIG. 10 is similar to FIG. 9 but showing the laser module and the screw cap fastened together.

Referring to FIGS. 9 and 10, when the laser module 3 is detached from the split socket 2 and the power control device 6 is disconnected from the laser module 3, a screw cap 7 with a metal clip 71 can be fastened to the laser module 3, so that the laser module 3 can be used independently as a laser pointer.

Figure 6:
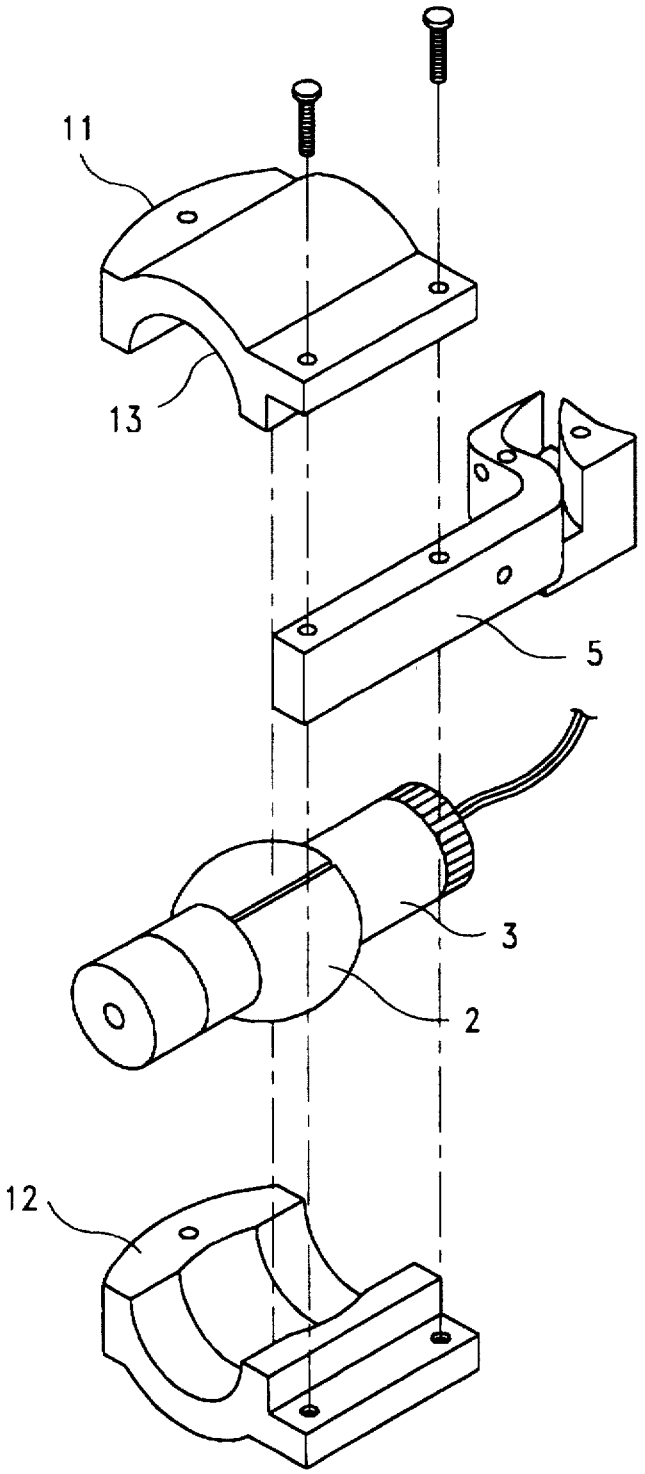
FIG. 6 shows an use of the laser module with a mounting frame according to the present invention.
Figure 11:
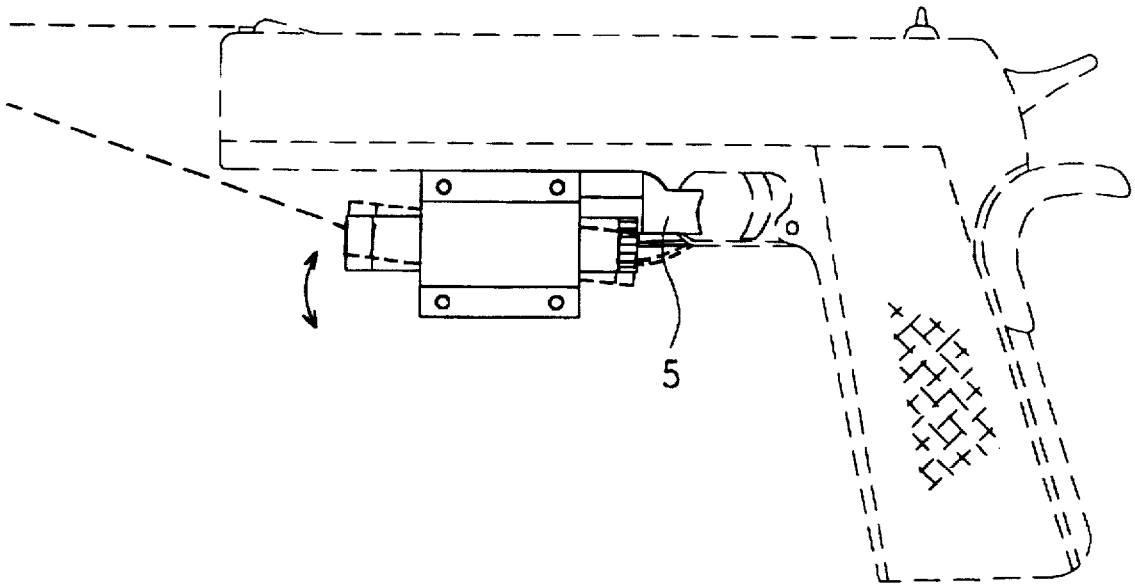
FIG. 11 is a schematic drawing of the present invention, showing the laser sight assembly installed in a pistol.

Referring to FIGS. 6 and 11, a mounting frame 5 may be fixedly secured to the casing 1 between the top shell 11 and the bottom shell 12, and adapted for securing the laser sight assembly to a weapon for example a pistol (see FIG. 11).

Figure 12:
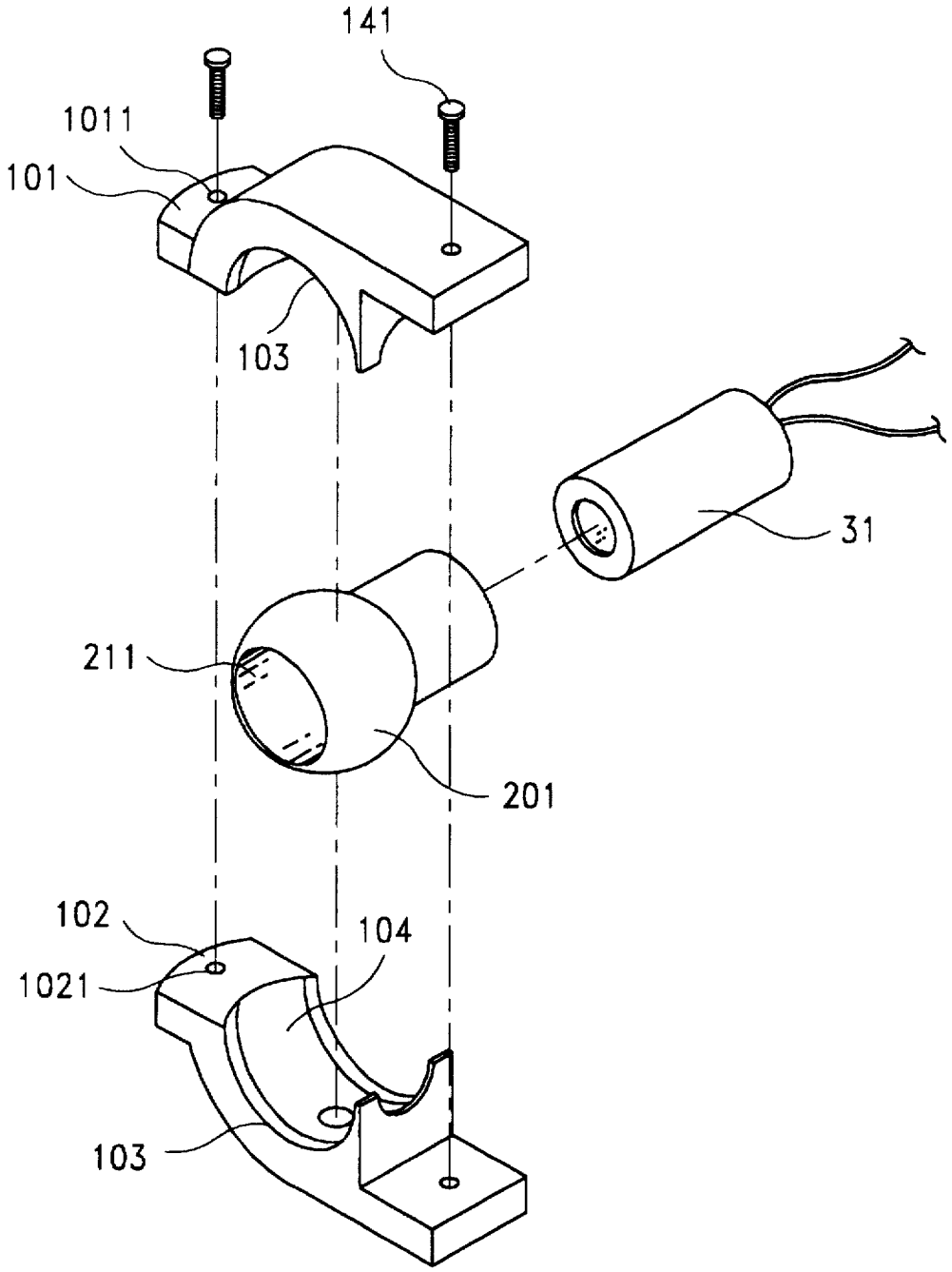
FIG. 12 is an exploded view of an alternate embodiment of the laser sight assembly according to the present invention.

FIG. 12 shows an alternate embodiment of the present invention. According to this alternate form, the laser sight assembly in also comprised of a casing 100, a socket member 201, and a laser module 31. The casing 100 is comprised of a top shell 101 and a bottom shell 102. The top shell 101 has a plurality of through holes 1011 respectively fastened to respective screw holes 1021 on the bottom shell 102 by screws 141. The top shell 101 and the bottom shell 102 comprise a respective longitudinal channel 103, and a respective smoothly curved transverse groove 104 on the respective longitudinal channel 103. When the top shell 101 and the bottom shell 102 are fastened together, the transverse grooves 104 form a ball socket holding the socket member 201. The socket member 201 has a spherical head and an elongated neck extended from the spherical head, and a longitudinal through hole 211 through the spherical head and the elongated neck for holding the laser module 31. When the laser module 31 is mounted in the longitudinal through hole 211 of the socket member 201 and the socket member 201 is mounted in the casing 100 within the ball socket of the smoothly curved transverse grooves 104, the socket member 201 can be turned within the ball socket to change the angular position of the laser module 31. Power supply for the laser module 31 is separately provided so that the size of the laser module 31 is diminished.

It is to be understood that the drawings are designed for purposes of illustration only, and are not intended as a definition of the limits and scope of the invention disclosed. For example, the split socket 2 or socket member 201, and the laser module 3 or 31 may be respectively coated with a layer of fluorescent material.

What the invention claimed is:

1. A laser sight assembly comprising a casing adapted for fixing to a gun, a socket member mounted in said casing, and a laser module mounted in said socket member and controlled to emit a laser beam for guiding the eye, wherein said casing comprises a top shell and a bottom shell fastened together, said top shell comprising a plurality of through holes, a longitudinal channel, and a smoothly curved transverse groove on said longitudinal channel, said bottom shell comprising a plurality of screw holes respectively fastened to said through holes of said top shell by screws, a longitudinal channel matching with said longitudinal channel of said top shell, and a smoothly curved transverse groove on said longitudinal channel of said bottom shell; said socket member is mounted within said casing between said smoothly curved transverse groove of said top shell and said smoothly curved transverse groove of said bottom shell, and can be turned between said top shell and said bottom shell to adjust the firing angle of said laser module.

2. The laser sight assembly of claim 1 further comprising a mounting frame fixedly fastened to said casing between said top shell and said bottom shell, and adapted for securing said casing to a gun.

3. The laser sight assembly of claim 1 wherein said smoothly curved transverse groove of said top shell and said smoothly curved transverse groove of said bottom shell form a ball socket holding said socket member on the inside of the casing, permitting said socket member to be turned therein.

4. The laser sight assembly of claim 3 wherein said socket member is a hollow, split, spherical socket having a longitudinal through hole which holds said laser module, and a split cut through the periphery.

5. The laser sight assembly of claim 1 further comprises a power control device detachably fastened to said laser module by a screw joint, and adapted for controlling the operation of said laser module.

6. The laser sight assembly of claim 1 wherein said laser module is detachably mounted with a screw cap by a screw joint, said screw cap having a metal clip for fastening, said screw cap being fastened to said laser module when said laser module is detached from said socket member and said casing for use independently as a laser pointer.

7. The laser sight assembly of claim 1 wherein said casing is coated with fluorescent material.

8. The laser sight assembly of claim 1 wherein said laser module is coated with fluorescent material.

9. The laser sight assembly of claim 1 wherein said socket member is positioned in said casing by a frictional force.

10. The laser sight assembly of claim 1 wherein said laser module is positioned in said socket member by a frictional force.

11. The laser sight assembly of claim 3 wherein said socket member comprises a spherical head and an elongated neck extended from said spherical head, and a longitudinal through hole through said spherical head and said elongated neck for holding said laser module.

12. The laser sight assembly of claim 9 or claim 10 wherein said laser module is detachably mounted with a screw cap by a screw joint, said screw cap having a metal clip for fastening, said screw cap being fastened to said laser module when said laser module is detached from said socket member and said casing for use independently as a laser pointer.

13. The laser sight assembly of claim 9 or claim 10 wherein said laser module is detachably mounted with a power control device by a screw joint for controlling the operation of said laser module.

* * * * *